US011603627B2

(12) United States Patent
Igarashi et al.

(10) Patent No.: US 11,603,627 B2
(45) Date of Patent: Mar. 14, 2023

(54) CARBON FIBER AND METHOD OF MANUFACTURING SAME

(71) Applicant: SHOWA DENKO K.K., Tokyo (JP)

(72) Inventors: Takeshi Igarashi, Tokyo (JP); Tomoyuki Takei, Tokyo (JP); Yu Gao, Tokyo (JP); Masumi Kuritani, Tokyo (JP)

(73) Assignee: SHOWA DENKO K.K., Tokyo (JP)

( * ) Notice: Subject to any disclaimer, the term of this patent is extended or adjusted under 35 U.S.C. 154(b) by 25 days.

(21) Appl. No.: 16/757,861

(22) PCT Filed: Oct. 17, 2018

(86) PCT No.: PCT/JP2018/038633
§ 371 (c)(1),
(2) Date: Apr. 21, 2020

(87) PCT Pub. No.: WO2019/082760
PCT Pub. Date: May 2, 2019

(65) Prior Publication Data

US 2021/0062408 A1 Mar. 4, 2021

(30) Foreign Application Priority Data

Oct. 27, 2017 (JP) ..... JP2017-208031

(51) Int. Cl.
*D06M 11/74* (2006.01)
*D06M 101/40* (2006.01)

(52) U.S. Cl.
CPC ..... *D06M 11/74* (2013.01); *D06M 2101/40* (2013.01)

(58) Field of Classification Search
CPC ..... D06M 11/74; D06M 2101/40
USPC ..... 428/368
See application file for complete search history.

(56) References Cited

U.S. PATENT DOCUMENTS

| | | | |
|---|---|---|---|
| 9,087,995 | B2 | 7/2015 | Virkar et al. |
| 2008/0089827 | A1 | 4/2008 | Miyazawa et al. |
| 2009/0176112 | A1 | 7/2009 | Kruckenberg et al. |
| 2011/0001086 | A1 | 1/2011 | Kruckenberg et al. |
| 2011/0204319 | A1 | 8/2011 | Virkar et al. |
| 2011/0204330 | A1 | 8/2011 | LeMieux et al. |
| 2011/0223339 | A1 | 9/2011 | Furukawa et al. |
| 2014/0001437 | A1 | 1/2014 | LeMieux et al. |
| 2016/0265143 | A1 | 9/2016 | Garnier |
| 2017/0314188 | A1 | 11/2017 | Komukai et al. |
| 2020/0299582 | A1 | 9/2020 | Komatsu |

FOREIGN PATENT DOCUMENTS

| | | | | |
|---|---|---|---|---|
| EP | 527035 | | 2/1993 | |
| JP | H05-116925 | | 5/1993 | |
| JP | 2005-035809 | | 2/2005 | |
| JP | 2005035809 | A * | 2/2005 | ..... B82Y 30/00 |
| JP | 2005-263617 | | 9/2005 | |
| JP | 2008-230912 | | 10/2008 | |
| JP | 2009-535530 | | 10/2009 | |
| JP | 2010-137155 | | 6/2010 | |
| JP | 2013-518439 | | 5/2013 | |
| JP | 2016-060969 | | 4/2016 | |
| RU | 2523483 | | 7/2014 | |
| RU | 2523483 | C1 * | 7/2014 | |
| WO | 2016/063809 | | 4/2016 | |
| WO | 2019/087965 | | 5/2019 | |

OTHER PUBLICATIONS

RU-2523483-C1 machine translation (Year: 2014).*
JP-2005035809-A machine translation (Year: 2005).*
Urvanov Sergey Alekseyevich et al., Carbon Fiber Modified with Carbon Nanotubes and Fullerenes for Fibrous Composite Application, Journal of Materials Science and Engineering A, Nov. 10, 2013, vol. 11, pp. 725-731.
International Search Report for PCT/JP2018/038625 dated Nov. 27, 2018.
International Search Report for PCT/JP2018/038633 dated Nov. 27, 2018.
International Search Report for PCT/JP2018/038620 dated Nov. 27, 2018.
Ogasawara et al., Mechanical properties of carbon fiber/fullerene-dispersed epoxy composite, Composites Science Technology, vol. 69, Issues 11-12, Sep. 2009, pp. 2002-2007.
Office Action dated May 18, 2022 issued with respect to the related U.S. Appl. No. 16/757,863.
American Elements, Fullerene Soot, accessed online Feb. 1, 2022.
Office Action dated Jun. 14, 2022 with respect to the related U.S. Appl. No. 16/756,250.

* cited by examiner

*Primary Examiner* — Vincent Tatesure
(74) *Attorney, Agent, or Firm* — IPUSA, PLLC

(57) ABSTRACT

By sequentially performing: a step (I) of dissolving fullerene $C_{60}$ in a polyalkylene glycol to prepare a fullerene solution; a step (II) of immersing a material carbon fiber in the fullerene solution; and a step (III) of extracting the carbon fiber from the fullerene solution, washing the extracted carbon fiber with water, and drying the carbon fiber washed with water, a carbon fiber on which fullerene $C_{60}$ adsorbs is obtained.

6 Claims, No Drawings

CARBON FIBER AND METHOD OF MANUFACTURING SAME

TECHNICAL FIELD

The present invention relates to a carbon fiber and a method of manufacturing the same.

BACKGROUND ART

Non-patent Document 1 discloses immersing a carbon fiber in a toluene solution of fullerene $C_{60}$ and thereafter drying it to obtain a carbon fiber with fullerene $C_{60}$ attached to the surface.

Patent Document 1 discloses a method of fullerene treatment of a carbon film surface by applying, with a brush or a spray, a dispersion liquid of isopropyl alcohol, in which fullerenes are dispersed, to a carbon film and then drying.

PRIOR ART DOCUMENT

Patent Document

[Patent Document 1] Japanese Laid-open Patent Publication No. 2010-137155

Non-Patent Document

[Non-Patent Document 1] Journal of Materials Science and Engineering A, 2013, 3(11), 725-731. 'Carbon Fiber Modified with Carbon Nanotubes and Fullerenes for Fibrous Composite Application'

SUMMARY OF THE INVENTION

Problem to be Solved by the Invention

However, in the method of Non-Patent Document 1, when the solvent evaporates from the carbon fiber, the aggregated and deposited fullerene is only unevenly attached to the carbon fiber surface, and the amount of fullerene attached to the carbon fiber is equal to the amount of fullerene dissolved in the solvent attached to the carbon fiber. Because the interaction between the deposited fullerene and the carbon fiber is small, when the carbon fiber is added as a reinforcing agent to resin, there is a problem that the effect of enhancing the interfacial shear strength between the carbon fiber and the resin is not sufficiently achieved. Also, in the method of Patent Document 1, fullerene is aggregated without being dissolved in a solvent, and thus the fullerene is only unevenly attached to the carbon fiber surface. Therefore, the effect of enhancing the interfacial shear strength between the fullerene and resin is insufficient.

In view of the above, the present invention has an object to provide a carbon fiber with fullerene adsorbed on the surface and a method of manufacturing the same.

Means for Solving the Problem

The inventors of the present invention have found that fullerene $C_{60}$ adsorbs on a carbon fiber under specific conditions. The inventors also have found that the carbon fiber have a higher interfacial shear strength with a resin than that of a carbon fiber on which fullerene is simply attached to the surface.

That is, the present invention provides the following in order to solve the above problems.

[1] A carbon fiber on which $C_{60}$ adsorbs.

[2] The carbon fiber according to [1], wherein the fullerene $C_{60}$ adsorbs by 0.001 parts by mass to 1 part by mass per 1000 parts by mass of the carbon fiber.

[3] A method of manufacturing a carbon fiber on which fullerene $C_{60}$ adsorbs sequentially performing:

a step (I) of dissolving fullerene $C_{60}$ in a polyalkylene glycol to prepare a fullerene solution;

a step (II) of immersing a material carbon fiber in the fullerene solution; and a step (III) of extracting the carbon fiber from the fullerene solution, washing the extracted carbon fiber with water, and drying the carbon fiber washed with water.

[4] The method of manufacturing the carbon fiber according to [3], wherein a concentration of the fullerene $C_{60}$ in the solution is 1 ppm by mass to 1000 ppm by mass.

[5] The method of manufacturing the carbon fiber according to [4], wherein the polyalkylene glycol is at least one kind selected from diethylene glycol, triethylene glycol, polyethylene glycol, dipropylene glycol, tripropylene glycol, and polypropylene glycol.

[6] The method of manufacturing the carbon fiber according to any one of [3] to [5], wherein the material carbon fiber is a polyacrylonitrile-based carbon fiber.

[7] The method of manufacturing the carbon fiber according to any one of [3] to [6], wherein a time of immersing the material carbon fiber in the step (II) is 5 seconds to 24 hours.

[8] The method of manufacturing the carbon fiber according to any one of [3] to [7], wherein a temperature of the solution during immersion in the step (II) is 10° C. to 100° C.

Effect of the Invention

According to the present invention, it is possible to obtain a carbon fiber having a high interfacial shear strength with resin.

EMBODIMENT FOR CARRYING OUT THE INVENTION

In the following, one embodiment will be described in detail. However, the present invention is not limited thereto, and can be implemented without departing from the scope of the present invention.

<Carbon Fiber>

A carbon fiber on which fullerene $C_{60}$ adsorbs according to the present embodiment is obtained by sequentially performing: a step (I) of dissolving fullerene $C_{60}$ in a polyalkylene glycol to prepare a fullerene solution; a step (II) of immersing a material carbon fiber (which is a carbon fiber on which fullerene $C_{60}$ has not adsorbed) in the fullerene solution; and a step (III) of extracting the carbon fiber from the fullerene solution, washing the extracted carbon fiber with water, and drying the carbon fiber washed with water.

Here, when performing the step (II), after immersing the material carbon fiber, the fullerene $C_{60}$ concentration in the solution decreases in comparison to the concentration before the immersion. This is also the result of adsorption of fullerene $C_{60}$ in the solution to the carbon fiber and an increase in the concentration of fullerene $C_{60}$ on the surface of the carbon fiber. The concentration of fullerene $C_{60}$ in the solution does not change simply by attachment as in Non-Patent Document 1 or Patent Document 1. Therefore, when the concentration of fullerene $C_{60}$ in the solution decreases, it is determined that the fullerene $C_{60}$ is adsorbed on the material carbon fiber, and when a decrease in the concentration is not observed, it is determined that fullerene $C_{60}$ is not adsorbed. It should be noted that the fullerene $C_{60}$ concentration in the solution is measured by a "method of measuring fullerene adsorption amount on carbon fiber", which will be described later below in Examples.

Here, the adsorption amount (parts by mass) of fullerene per 1000 parts by mass of carbon fiber is calculated by the following formula (1).

$$\text{Adsorption amount}=([\text{Concentration of fullerene } C_{60} \text{ in fullerene solution before adsorption (ppm by mass)}]-[\text{Concentration of fullerene } C_{60} \text{ in fullerene solution after adsorption (ppm by mass)}])\times[\text{Mass of fullerene solution (g)}]/[\text{Mass of carbon fiber (mg)}] \quad (1)$$

Per 1000 parts by mass of the carbon fiber, the adsorption amount of the fullerene $C_{60}$ is preferably 0.001 parts by mass to 2 part by mass, is more preferably 0.01 parts by mass to 1 parts by mass, and is further more preferably 0.05 parts by mass to 0.5 parts by mass. When the adsorption amount is in this range, it is sufficiently easy to obtain the effect of enhancing the interfacial shear strength with resin.

Next, a method of manufacturing a carbon fiber on which fullerene $C_{60}$ adsorbs will be described.

<Step (I)>

In the step (I), fullerene $C_{60}$ is dissolved in a polyalkylene glycol to prepare a fullerene solution.

The concentration of the fullerene $C_{60}$ in the solution in the step (I) is preferably 1 ppm by mass to 1000 ppm by mass, is more preferably 3 ppm by mass to 500 ppm by mass, and is further more preferably 10 ppm by mass to 500 ppm by mass. When the concentration is greater than or equal to the lower limit of this range, fullerene $C_{60}$ is easily adsorbed. When the concentration is less than or equal to the upper limit of this range, the solution is easily prepared and it is economically advantageous.

A polyalkylene glycol is used as the solvent for the solution in the step (I). Specifically, it is preferable to select, as the polyalkylene glycol, at least one kind from diethylene glycol, triethylene glycol, polyethylene glycol, dipropylene glycol, tripropylene glycol, and polypropylene glycol. Dipropylene glycol, tripropylene glycol, and polypropylene glycol are more preferable, and tripropylene glycol and polypropylene glycol are further more preferable. By using such a solvent, fullerene $C_{60}$ is easily adsorbed.

<Step (II)>

In the step (II), a material carbon fiber is immersed in the fullerene solution.

As the material carbon fiber used in the step (II), either a pitch-based carbon fiber (carbon fiber made from pitch) or a polyacrylonitrile-based carbon fiber (carbon fiber made from polyacrylonitrile) can be used, and a polyacrylonitrile-based carbon fiber is preferable. Such a material carbon fiber is generally used as a reinforcing agent for a carbon fiber reinforced plastic or the like, and is often desired to have a high interfacial shear strength with resin.

The time of immersing the carbon fiber in the step (II) is preferably 5 seconds to 24 hours, is more preferably 5 minutes to 12 hours, and is further more preferably 30 minutes to 2 hours. When the time is greater than or equal to the lower limit of this range, fullerene $C_{60}$ is easily adsorbed. Although the immersion may be performed for a further long time, the adsorption amount does not easily increase. Therefore, when the time is less than or equal to the upper limit of this range, the processing time is short, which is economically advantageous.

Although the fullerene solution may be used without particularly being cooled or warmed at the time of immersion in the step (II), the temperature of the fullerene solution is preferably 10° C. to 100° C., is more preferably 15° C. to 80° C., and is further more preferably 20° C. to 60° C. Within this range, fullerene $C_{60}$ is easily adsorbed and the energy of cooling or heating is small, which is economical.

<Step III>

In the step (III), the carbon fiber is extracted from the fullerene solution of the step (II), the extracted carbon fiber is washed with water, and the carbon fiber washed with water is dried. The method of extracting the carbon fiber is not particularly limited, but filtration is preferable because the subsequent water washing is easily performed. The water washing may be performed such that the solution of the step (II) remaining between the carbon fiber is replaced with water to an extent and may be performed so as not to disturb the subsequent drying. The drying may be performed by heating, decompression, air drying, or the like to an extent that water is removed, and is not particularly limited.

<Use>

A carbon fiber according to the present embodiment has a high interfacial shear strength with resin and thus is preferably used for a carbon fiber reinforced plastic.

EXAMPLES

In the following, the present invention will be described in more detail with reference to Examples and Comparative Examples. However, the present invention is not limited to Examples below.

Example 1

Using dipropylene glycol as a solvent, in 10 g of a solution prepared by dissolving 2 ppm by mass of fullerene $C_{60}$ (Nanom™ purple SUH manufactured by Frontier Carbon Corporation) in the solvent, 100 mg of a carbon fiber (carbon fiber tow PYROFIL™ TR50S12L manufactured by Mitsubishi Rayon Co., Ltd.) from which sizing agent has been removed in advance with dichloromethane was immersed and left at room temperature (approximately 20° C.) for a time period described in Table 1. The solution and the carbon fiber were separated by filtration, and the solution was used for fullerene adsorption measurement. The separated carbon fiber was washed with water, dried at 100° C. for 2 hours under reduced pressure, and thereafter used for an interfacial shear strength test.

Examples 2 to 4

With the exception of using, as a solvent, polyalkylene glycol described in Table 1 and using, as a fullerene solution, a solution prepared by dissolving 10 ppm by mass of fullerene $C_{60}$ in the solvent, operations and tests were performed similarly to Example 1.

Example 5

With the exception of using, as a solvent, tripropylene glycol and using, as a fullerene solution, a solution prepared by dissolving 10 ppm by mass (6 ppm by mass as $C_{60}$) of Nanom™ mix ST (60% by mass is $C_{60}$ and the others are fullerene higher than $C_{60}$ manufactured by Frontier Carbon Corporation in the solvent, operations and tests were performed similarly to Example 1.

Comparative Examples 1 to 4

With the exception of using solvents described in Table 1, without performing water washing (because the solvents are not compatible with water), and performing air drying as the drying, operations were performed similarly to Examples.

<Method of Measuring Fullerene Adsorption Amount on Carbon Fiber>

For each of Examples and Comparative Examples, by high-performance liquid chromatography (device: high-performance liquid chromatography 1200 Series manufactured by Agilent Technology; column: column YMC-pack ODS-AM manufactured by YMC Co., Ltd.; developing solvent (volume ratio): toluene/methanol=51/49; flow rate: 1.2 mL/min; detection method: 308 nm ultraviolet light absorption) for which a calibration curve was created in advance with a toluene solution of fullerene $C_{60}$, the concentration of $C_{60}$ in the fullerene solution before and after carbon fiber immersion was measured to calculate the adsorption amount of the fullerene on the carbon fiber according to the above-described formula (1).

<Interfacial Shear Strength Test>

For each of Examples and Comparative Examples, the interfacial shear strength was evaluated by a microdroplet test using a composite material interface property evaluation apparatus model HM410 manufactured by Toei Sangyo Co., Ltd. The microdroplet test was conducted on the carbon fiber obtained by each of Examples and Comparative Examples as a sample, (resin: PEEK 450G manufactured by Victrex plc; temperature: room temperature; atmosphere: air atmosphere; pulling rate: 0.12 mm/min). Each sample was measured 5 times and the average value was adopted.

TABLE 1

| | SOLVENT | $C_{60}$ CONCENTRATION IN FULLERENE SOLUTION (PARTS BY ppm) | IMMERSION TIME (h) | ADSORPTION AMOUNT OF FULLERENE $C_{60}$ PER 1000 PARTS BY MASS OF CARBON FIBER (PARTS BY MASS) | INTERFACIAL SHEAR STRENGTH (MPa) |
|---|---|---|---|---|---|
| Example 1 | DIPROPYLENE GLYCOL | 2 | 24 | 0.015 | 113.1 |
| Example 2 | TRIPROPYLENE GLYCOL | 10 | 24 | 0.066 | 120.8 |
| Example 3 | POLYPROPYLENE GLYCOL | 10 | 24 | 0.066 | 119.2 |
| Example 4 | TRIPROPYLENE GLYCOL | 10 | 2 | 0.059 | 118.3 |
| Example 5 | TRIPROPYLENE GLYCOL | 6 | 24 | 0.012 | 118.6 |
| Comparative Example 1 | TOLUENE | 10 | 24 | 0.000 | 107.3 |
| Comparative Example 2 | DICHLOROMETHANE | 10 | 24 | 0.000 | 105.6 |
| Comparative Example 3 | DECAHYDRONAPHTHALENE | 10 | 24 | 0.000 | 106.3 |
| Comparative Example 4 | CYCLOHEXANE | 10 | 24 | 0.000 | 104.5 |

Dipropylene Glycol: 1st Grade reagent manufactured by Wako Pure Chemical Corporation Tripropylene Glycol: 1st Grade reagent (mixture of isomers) manufactured by Wako Pure Chemical Corporation Polypropylene Glycol: PPG700 (diol type) manufactured by Wako Pure Chemical Corporation Toluene: Special Grade reagent manufactured by Wako Pure Chemical Corporation Dichloromethane: Special Grade reagent manufactured by Wako Pure Chemical Corporation Decahydronaphthalene: 1st Grade reagent manufactured by Wako Pure Chemical Corporation Cyclohexane: Special Grade reagent manufactured by Wako Pure Chemical Corporation The present application is based on and claims priority to Japanese Patent Application No. 2017-208031, filed on Oct. 27, 2017, the entire contents of which are hereby incorporated herein by reference.

The invention claimed is:

1. A method of manufacturing a carbon fiber on which fullerene $C_{60}$ adsorbs, the method comprising sequentially performing:

dissolving fullerene $C_{60}$ in a polyalkylene glycol to prepare a fullerene solution;

immersing a material carbon fiber in the fullerene solution; and extracting the carbon fiber from the fullerene solution, washing the extracted carbon fiber with water, and drying the carbon fiber washed with water.

2. The method of manufacturing the carbon fiber according to claim 1, wherein a concentration of the fullerene $C_{60}$ in the solution is 1 ppm by mass to 1000 ppm by mass.

3. The method of manufacturing the carbon fiber according to claim 1, wherein the polyalkylene glycol is at least one kind selected from diethylene glycol, triethylene glycol, polyethylene glycol, dipropylene glycol, tripropylene glycol, and polypropylene glycol.

4. The method of manufacturing the carbon fiber according to claim 1, wherein the material carbon fiber is a polyacrylonitrile-based carbon fiber.

5. The method of manufacturing the carbon fiber according to claim 1, wherein a time of immersing the material carbon fiber is 5 seconds to 24 hours.

6. The method of manufacturing the carbon fiber according to claim 1, wherein a temperature of the solution during immersion is 10° C. to 100° C.

* * * * *